United States Patent [19]

Carlton

[11] Patent Number: 4,662,347

[45] Date of Patent: May 5, 1987

[54] ON-BOW/OFF-BOW ARCHERY SIGHT

[76] Inventor: William G. Carlton, P.O. Box 592, Folly Beach, S.C. 29439

[21] Appl. No.: 713,346

[22] Filed: Mar. 18, 1985

[51] Int. Cl.[4] ..... F41B 5/00; F41G 1/00

[52] U.S. Cl. ..... 124/87; 33/265; 124/24 R

[58] Field of Search ..... 124/23 R, 87, 24 R; 33/265

[56] References Cited

U.S. PATENT DOCUMENTS

| | | | |
|---|---|---|---|
| 3,641,675 | 2/1972 | Funk | 33/265 |
| 3,648,376 | 3/1972 | Millnamow | 33/265 |
| 4,177,572 | 12/1979 | Hindes | 33/265 |
| 4,462,163 | 7/1984 | Teutler et al. | 33/265 |
| 4,542,591 | 9/1985 | Montgomery | 124/87 |

*Primary Examiner*—Richard C. Pinkham
*Assistant Examiner*—Benjamin Layno
*Attorney, Agent, or Firm*—B. Craig Killough

[57] ABSTRACT

An archery sight is disclosed which may be mounted on a bow, and which has one or more sight pins or similar reference points which may be sighted over an object target, and which has an additional sight pin or similar reference point which may be sighted over a target located on the bow, so that when each pin appears over the respective targets, the precise position of the bow is defined which will produce an accurate shot.

4 Claims, 4 Drawing Figures

ON-BOW/OFF-BOW ARCHERY SIGHT

BACKGROUND AND SUMMARY OF THE INVENTION

This invention relates generally to the field of archery, and more specifically and more particularly to a bow sight to improve the aim and accuracy of an archery shot.

Aiming and sighting has always been important in archery, although such aiming has historically been as simple as sighting down the length of the arrow. Ancient archers would raise the attitude of the bow, then view the tip of the arrow and line it up with a point on the field. The higher the attitude of the bow and point of the arrow, the farther the shot would travel, and ancient archers became accustomed to how far the arrow would travel in such a manner. In modern times, more sophisticated sighting devices placed upon the bow have come about, however, these sighting devices share the common feature that some object upon the bow is lined up with the target at which the arrow is to be fired. This type of sighting is referred to herein as "off bow sighting".

The most common sighting device in use today incorporates a rack such as that shown in FIG. 2. As the rack 12 is commonly used, it is mounted so as to be on the side of the bow 2 opposite that shown in FIG. 2, so that the bow is between the rack and the archer, rather than the rack being between the bow and the archer. The rack contains a multiplicity of slots, usually three or four, and within the slots are placed a series of pins which may be placed as desired within the slots and fixed in place by tightening the threads. Simply described, this type of off bow sighting is accomplished by placing the appropriate pin over the target. The series of pins accomplishes much the same function as the ancient archer's positioning the point of the arrow over a point down field. As increased distance is desired, a pin which is positioned lower on the rack is sighted over the target, having the effect of raising the attitude of the bow, thereby allowing for different distances. The archer uses the series of pins to match the desired attitude of the bow with the distance that the arrow will travel, given the particular strength of the archer and the bow. The archer then will generally position the pins for targets which are 25, 50, or 75 yards away, or whatever interval the archer may desire.

While the rack and pin sighting device of the prior art can be set to achieve relative accuracy with regard to the angle of elevation, thereby correcting the distance the shot is to travel, it does not aid the archer in positively determining the spacial orientation of the bow. The conventional one pin per distance sight is based on a single axis, which is a line extending from the eye of the archer, through the sight pin and to the target. The spacial orientation of the bow with reference to the viewer and the target may result in the apparent proper alignment of the sight pin over the target, yet the bow may be rotated inadvertently around the longitudinal axis (y-axis) of the bow while the sight pin still appears to be in the same relative position over the target. Through natural ability and instinct, sharpened with practice, the archer attempts to reduce the spacial orientation of the bow to the single axis line of sight, minimizing the effect of parallax.

The present invention uses the rack and pin sighting commonly in use as a means of off-bow sighting to establish elevation by rotation in a plane containing the y-axis and the bowstring. However, the present invention improves the prior art by providing positive spacial orientation. This is accomplished by means of a second sighting pin located on the bow, and a target which is also located on the bow, which is called herein "on-bow" sighting. The purpose of the on-bow sighting operation is to determine a line of sight from the archer, through the sighting pin to the on-bow target, for the purpose of controlling the rotation of the bow around its y-axis. In use, as will be more fully demonstrated herein, the archer aligns the on-bow sight pin over the on-bow target, while simultaneously aligning the selected off-bow sight pin with the intended target, and by doing so eliminates the parallax problem, resulting in an accurate shot. The on-bow/off-bow sight yields consistency and reproducibility of results. As will be seen more fully herein, the on-bow sight pin position is set for each archer's shooting characteristics. While archers of similar strength and build may be able to use the same sight pin position, the device allows for additional pins so that more than one archer can use the bow.

DETAILED DESCRIPTION OF THE DRAWINGS

DETAILED DESCRIPTION OF THE PREFERRED EMBODIMENT

Figure 1:
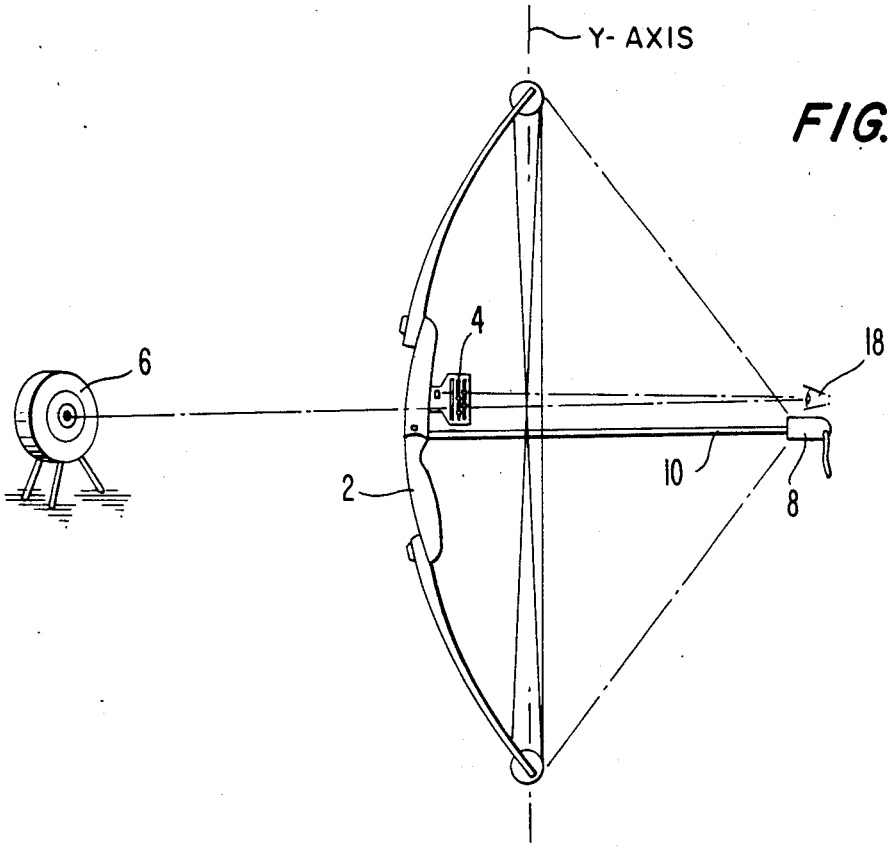
FIG. 1 is a perspective view of a compound bow incorporating the on-bow/off-bow sighting device, and further showing a target.

FIG. 1 shows a compound bow 2 with the on-bow/-off-bow sight 4 invention attached to the bow, with the archer's lines of sight as the device is sighted and the arrow aimed at the down field target 6. The compound bow 2 as shown is of the type commonly in use today, however, it is shown with a trigger mechanism 8 attached to the bow 2 by a support rod 10, which is not necessary to the invention. The device may be used with any type of archery bow.

Figure 2:
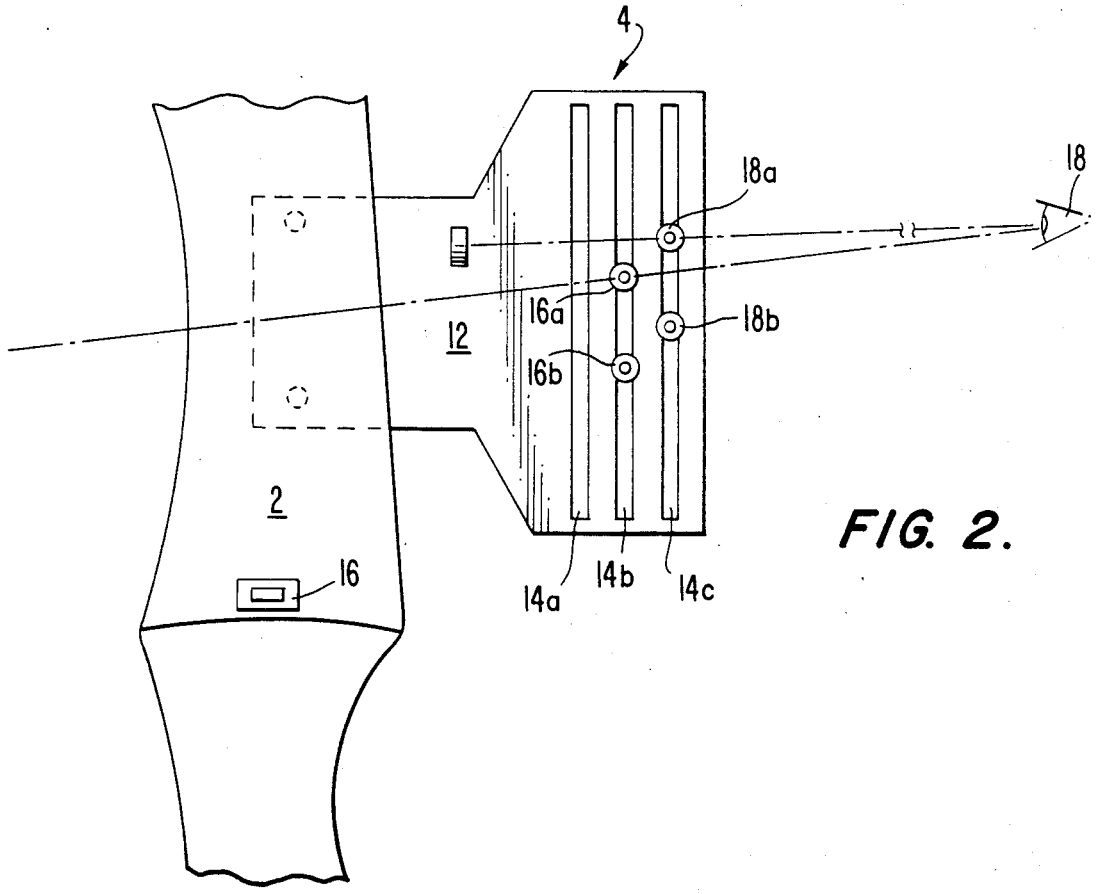
FIG. 2 is a partial, enlarged view of a bow showing the on-bow/off-bow sighting device being sighted by the archer, and showing the lines of sight.
Figure 3:
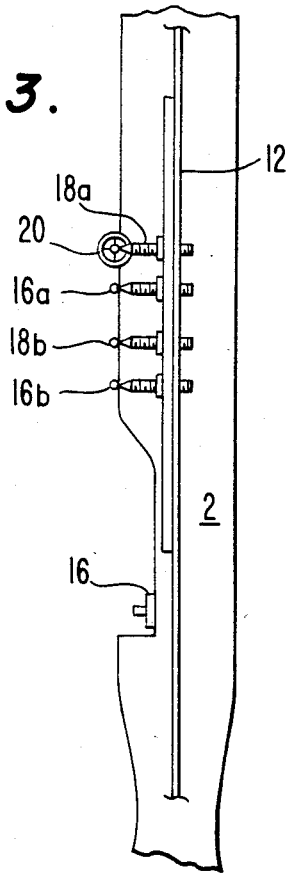
FIG. 3 is a partial, enlarged view of the compound bow incorporating the on-bow/off-bow sighting device, showing the sight as viewed by the archer.

The on-bow/off-bow sighting device is shown as enlarged in FIG. 2, and details the features and lines of sight of the archer. A rack 12 having a multiplicity of slots 14*a,b,c* is located and attached to the bow 2 between the archer and the bow. It is attached just above the point 17 where the arrow crosses the bow when the bow is drawn and the arrow is in place. The rack is attached so that it is in the line of sight between the eye 19 of the archer and the down field target 6.

The rack 12 is commonly in use and commercially available as are the pins which are located within it. The rack 12 contains a series of parallel slots 14*a,b,c,* which will usually be three or four slots, into which sight pins 16*a,b;* 18*a,b* are placed. The pins as shown in the drawings are commercially available, being generally cylindrical and threaded on one end for attachment to the rack by means of a nut or similar fastener. The opposite end has a relatively small, circular point for locating over the target. However, any object having a point which can be located over a target for reference can be substituted for the pins.

The off-bow sight pins 16*a,b* are placed by the archer according to his individual strength and shooting characteristics as well as the characteristics of the bow. An off-bow sight pin 16*a,b* is located over the down field target 6, with the particular off-bow sight pin 16*a* which is to be used being selected according to the distance to the target. Through shooting experience and experimentation, the off-bow sight pins are particularly positioned within a slot or slots 14. The farther away the target is, the lower the sight pin which is selected, having the effect of raising the attitude of the bow and the tip of the arrow so that greater distance is achieved. For example, pin 16*b* is used for targets which are a greater distance from the archer, and 16*a* for targets which are closer. While two off-bow pins are shown, additional pins may be added for greater versatility. Mechanically, the pins are moved within the slots by sliding them to the desired position, then tightening them into place by threaded means.

Figure 4:
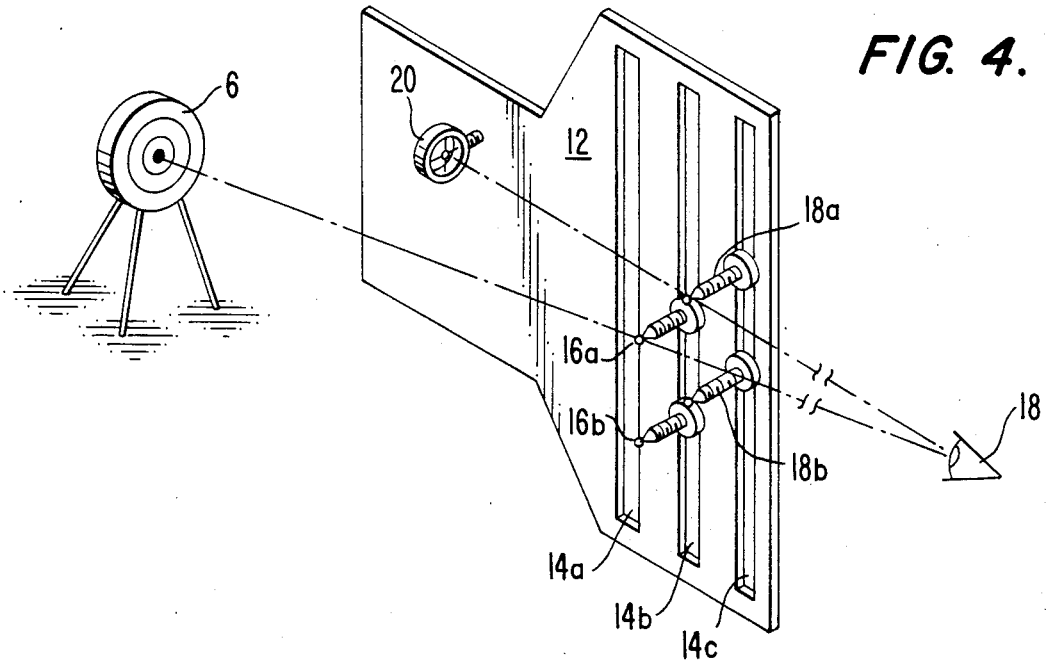
FIG. 4 is a perspective view showing the on-bow/-off-bow sight only, and showing the lines of sight.

The present invention adds the rack 12 an on-bow sighting feature. One or more pins 18*a,b* which are virtually identical to the off-bow sighting pins 16*a,b* are located within the rack on a different slot 14*c*. An on-bow target 20 is also located on the rack 12. The target 20 may be located on the bow itself. As is shown particularly in FIG. 4, this target 20 may be round and have crosshairs located thereon. As demonstrated with the sight lines in the drawings, the archer selects the appropriate off-bow sight pin 16*a* according to distance, lines the off-bow sight pin 16*a* over the target 6, and selects the on-bow sight pin 18*a* which is suited to the archer's characteristics and lines it up over the on-bow target 20. Positioning of the on-bow sight pin is adjusted similarly to the off-bow pins through the experimentation and experience of the archer. Once the position of the on-bow target and pin are fixed, they need not be adjusted again.

While the archer uses various off-bow sight pins according to distance, it is necessary for a particular archer to only use one on-bow sight pin, no matter which off-bow sight pin is selected. Additional on-bow sight pins may be placed in the slot so that other archers may use the sight.

Once the appropriate off-bow sight pin is located over the target, and the appropriate on-bow configuration is achieved, the bow and arrow have been appropriately aimed, and the arrow may be released and fired by the archer. The invention improves the accuracy of the slot by eliminating the parallax problem experienced with the sights presently in use. As can be seen, if only the off-bow sight were lined up over the target, the bow can be rotated inadvertently around its longitudinal axis (y-axis), with the arrow's travel along the horizontal plane not determined by the sight. The rack and off-bow sight pins which are commonly in use are a great aid in determining the distance and elevation of the arrow relative to the target, but aid to a lesser degree the windage when aiming the bow and accompanying arrow. The present invention accurately and objectively positions the bow as to elevation and windage by sighting the off-bow pin over the down field target 6, and the on-bow pin over target 20, which is located on the bow. Only one position of the bow will allow both targets to be sighted and it is this position which gives an accurate shot.

The concept of sighting a target which is on the bow in conjunction with sighting a target which is off the bow creates a new and unexpected result in increasing the accuracy of the archery shot. While the present invention incorporates the off-bow rack and sight pin device which is commonly in use, modifying or adding to it an on-bow sight pin and an on-bow target, various embodiments can be used.

It would be possible to reverse the position of the on-bow sight pin and the on-bow target. The target would need to be transparent, with crosshairs thereon, in such a configuration. Magnification could be added to the target if desired. Magnification could also be added either between the archer and the sight pins, or between the sight pins and the targets, if desired.

What is claimed:

1. In the method of aiming a bow which has a bowstring, a bow sight rack attached to the bow, said rack having a plurality of parallel slots therein, said slots being parallel to said bow, at least one on-bow sight pin located on said rack, at least one off-bow sight pin located within said parallel slots, and an on-bow target located on one of said rack and bow;

the steps of:

(a) aligning an on-bow sight pin on said on-bow target while simultaneously aligning a selected off-bow sight pin with the intended off-bow target, and (b) releasing said bowstring from a drawn position while maintaining the alignment of said pins on said targets.

2. A method of aiming a bow as described in claim 1, wherein said at least one off-bow sight pin is located in one of said slots, and at least one of said on-bow sight pins is located in another of said slots.

3. A method of aiming a bow as described in claim 2, wherein said at least one off-bow sight pin is located between said on-bow sight pin and said bow.

4. A method of aiming a bow as described in claim 3, wherein said target is located on said rack between said pins and said bow.

* * * * *